US007757610B2

(12) United States Patent
Saxton et al.

(10) Patent No.: US 7,757,610 B2
(45) Date of Patent: Jul. 20, 2010

(54) SHORTENED CONTAINER WELL

(75) Inventors: Gregory J. Saxton, Portland, OR (US); John N. Niosi, Portland, OR (US); Scott D. Krupp, Beaverton, OR (US)

(73) Assignee: Gunderson LLC, Portland, OR (US)

( * ) Notice: Subject to any disclaimer, the term of this patent is extended or adjusted under 35 U.S.C. 154(b) by 211 days.

(21) Appl. No.: 12/221,089

(22) Filed: Jul. 30, 2008

(65) Prior Publication Data

US 2010/0024680 A1 Feb. 4, 2010

(51) Int. Cl.
*B61D 3/00* (2006.01)

(52) U.S. Cl. ..... 105/404; 105/355; 105/411; 29/897.1; 29/897.2; 29/401.1; 29/426.4

(58) Field of Classification Search ..... 105/355, 105/396, 404, 407, 410, 411, 413, 414, 417, 105/418, 419, 420, 421; 410/52, 53, 54, 410/71; 29/401.1, 897.1, 897.2, 428, 426.4, 29/445, 462

See application file for complete search history.

(56) References Cited

U.S. PATENT DOCUMENTS

| | | | |
|---|---|---|---|
| 717,488 | A | 5/1903 | Swanson |
| 1,085,196 | A | 1/1914 | Downing |
| 1,110,394 | A | 9/1914 | Lindall |
| 114,552 | A | 10/1914 | Taurman |
| 1,168,335 | A | 1/1916 | Rowntree |
| 1,617,658 | A | 2/1927 | Suarez |
| 1,634,490 | A | 7/1927 | Collis |
| 1,696,332 | A | 12/1928 | Sheehan |
| 1,699,520 | A | 1/1929 | Gibbs et al. |
| 1,699,529 | A | 1/1929 | Gibbs et al. |
| 1,875,584 | A | 9/1932 | Frede et al. |
| 1,889,605 | A | 11/1932 | Jones |
| 2,052,213 | A | 8/1936 | Branstrator |
| 2,194,356 | A | 3/1940 | Eklund |
| 2,255,900 | A | 9/1941 | Schlessinger |
| 2,278,554 | A | 4/1942 | Morton |
| 2,279,756 | A | 4/1942 | Lieberman |
| 2,327,585 | A | 8/1943 | Ulrich |
| 2,401,401 | A | 6/1946 | Bartsch |

(Continued)

FOREIGN PATENT DOCUMENTS

| | | |
|---|---|---|
| DE | 3711409 | 10/1987 |

(Continued)

OTHER PUBLICATIONS

U.S. Appl. No. 11/985,400, filed Nov. 4, 2007, Saxton et al.

*Primary Examiner*—Mark T Le
(74) *Attorney, Agent, or Firm*—Chernoff, Vilhauer, McClung & Stenzel, LLP

(57) ABSTRACT

A joint connecting a container corner support assembly to a body bolster and a connecting assembly portion of an end of a container well unit in connection with shortening a container well of a railroad freight car intended for carrying an intermodal freight container. A connector member is welded into position, between a transverse gusset plate of a container corner support assembly and a closure plate of a connecting assembly, to transmit forces between the gusset plate and the connecting assembly associated with a body bolster in an end of the container well unit.

11 Claims, 9 Drawing Sheets

U.S. PATENT DOCUMENTS 2,504,112 A 4/1950 Dean et al.
3,102,613 A 9/1963 Johnston
3,152,667 A 10/1964 Johnston
3,152,669 A 10/1964 Johnston
3,181,440 A 5/1965 Mullaney et al.
3,290,058 A 12/1966 Ellerd
3,308,769 A 3/1967 Halcomb et al.
3,319,583 A 5/1967 Gutridge
3,357,371 A 12/1967 Gutridge
3,389,663 A 6/1968 Gutridge
3,420,192 A 1/1969 Ellis
3,520,256 A 7/1970 Gutridge
3,616,764 A 11/1971 Johnson et al.
3,645,213 A 2/1972 Taylor
3,659,724 A 5/1972 Miller et al.
3,731,967 A 5/1973 Hughes
3,818,843 A 6/1974 Lee
3,981,548 A 9/1976 MacDonnell et al.
4,064,947 A 12/1977 Cole
4,091,742 A 5/1978 Cordani
4,150,628 A 4/1979 Keldenich
4,179,997 A 12/1979 Kirwan
4,191,107 A 3/1980 Ferris et al.
4,233,909 A 11/1980 Adams et al.
4,274,776 A 6/1981 Paton et al.
4,288,957 A 9/1981 Meehan
4,331,083 A 5/1982 Landregan et al.
4,408,810 A 10/1983 Geyer
4,428,296 A 1/1984 Scheuchzer et al.
4,452,147 A 6/1984 Jwuc
4,456,413 A 6/1984 Pavlick
4,524,699 A 6/1985 Pavlick
4,563,957 A 1/1986 Billingsley et al.
4,597,337 A 7/1986 Willetts
4,599,949 A 7/1986 Hill
4,624,188 A 11/1986 Kaleta
4,671,714 A 6/1987 Bennett
4,686,907 A 8/1987 Woollam et al.
4,703,699 A 11/1987 Hill
4,718,353 A 1/1988 Schuller et al.
4,741,273 A 5/1988 Sherwood
4,750,431 A 6/1988 Yates et al.
4,751,882 A 6/1988 Wheatley et al.
4,754,709 A 7/1988 Gramse et al.
4,771,706 A 9/1988 Lindauer et al.
4,782,762 A 11/1988 Johnstone et al.
4,792,269 A 12/1988 Engle
4,798,148 A 1/1989 Girard
4,802,420 A 2/1989 Butcher et al.
4,805,539 A 2/1989 Ferris et al.
4,807,722 A 2/1989 Jamrozy et al.
4,841,876 A 6/1989 Gramse et al.
4,862,810 A 9/1989 Jamrozy et al.
4,864,938 A 9/1989 Hesch et al.
4,876,968 A 10/1989 Lindauer et al.
4,889,055 A 12/1989 Jamrozy et al.
4,893,567 A 1/1990 Hill et al.
4,901,649 A 2/1990 Fehrenbach et al.
4,905,608 A 3/1990 Terlecky et al.
4,909,157 A 3/1990 Jamrozy et al.
4,911,082 A 3/1990 Richmond
4,929,132 A 5/1990 Yeates et al.
4,947,760 A 8/1990 Dawson et al.
4,949,646 A 8/1990 Jamrozy et al.
4,951,575 A 8/1990 Dominguez et al.
4,955,144 A 9/1990 Lienard et al.
4,966,082 A 10/1990 Takeichi et al.
5,001,990 A 3/1991 Pavlick
5,017,064 A 5/1991 Kirwan et al.
5,020,445 A 6/1991 Adams, Jr.
5,054,403 A 10/1991 Hill et al.
5,085,152 A 2/1992 Tylisz et al.
5,090,331 A 2/1992 Hesch et al.
5,170,718 A 12/1992 Hill et al.
5,197,392 A 3/1993 Jeunehomme
5,207,161 A 5/1993 Pileggi et al.
5,216,956 A 6/1993 Adams, Jr.
5,246,321 A 9/1993 Hesch
5,279,230 A 1/1994 Thomas et al.
5,372,073 A 12/1994 Cattani
5,407,309 A 4/1995 Hesch et al.
5,423,269 A * 6/1995 Saxton et al. ..... 105/355
5,452,664 A 9/1995 Richmond
5,465,670 A 11/1995 Butcher
5,501,556 A 3/1996 Butcher
5,511,491 A 4/1996 Hesch et al.
5,520,489 A * 5/1996 Butcher et al. ..... 410/94
5,611,285 A 3/1997 Saxton
5,626,083 A 5/1997 Saxton
5,657,698 A 8/1997 Black, Jr. et al.
5,730,063 A * 3/1998 Forbes et al. ..... 105/355
5,743,191 A * 4/1998 Coslovi ..... 105/355
5,749,686 A 5/1998 Butcher et al.
6,003,445 A * 12/1999 Coslovi et al. ..... 105/355
6,095,055 A 8/2000 Lohr et al.
6,196,137 B1 * 3/2001 Forbes ..... 105/413
6,199,486 B1 3/2001 Landrum et al.
6,357,363 B1 3/2002 Militaru
6,505,564 B2 * 1/2003 Khattab ..... 105/413
6,510,800 B1 1/2003 Zaerr et al.
6,546,878 B1 4/2003 Smith et al.
6,584,912 B2 7/2003 Forbes
7,654,206 B2 * 2/2010 Saxton ..... 105/411
2007/0261593 A1 11/2007 Saxton
2009/0078152 A1 * 3/2009 Halliar et al. ..... 105/355

FOREIGN PATENT DOCUMENTS

EP 0510372 10/1992
EP 0510467 10/1992

* cited by examiner

SHORTENED CONTAINER WELL

BACKGROUND OF THE INVENTION

The present invention relates to railroad freight cars including wells for carrying intermodal freight containers, and relates particularly to shortening existing container well cars to carry containers of a shorter length.

Many railroad freight cars were built over a period of several years, beginning in the 1980's, to be able to carry containers 48 feet long, as well as containers of the international standard 40-foot length, in container wells defined between deep side sills of the car bodies. Cars of this type are disclosed in U.S. Pat. No. 5,170,718, for example. Many of such 48-foot well cars were built as multi-unit cars, each usually having five container-well car units permanently coupled together. Recently, longer containers such as nominal 53-foot containers have largely replaced 48-foot containers. Since 48-foot well cars cannot accept the 53-foot containers, the cars with 48-foot wells began to be used largely for carrying 40-foot containers. Because of their greater length and weight, such cars are less efficient and more costly to use to carry 40-foot containers, and so owners of the cars have shortened many cars so that the container wells can still carry 40-foot containers, but don't have the extra eight-foot well length. The weight of material removed from the car bodies can be replaced by freight-earning lading without exceeding gross weight limitations. Also, more of the shortened cars can be included in a freight train without exceeding train length limitations.

It has been discovered that in many shortened container-well car units joints interconnecting the side sills and container corner support structures with the body bolsters and adjacent end portions of the car unites showed signs of failures and inability to sustain the loads resulting from carrying the lading for which the car units had been designed. Subsequent investigation revealed that gaps had remained unexpectedly unwelded between certain parts during the process of rejoining the ends of the well car units to shortened side sills, and a critical portion of the intended welded interconnection between end portions of the car units and the adjacent container well structures had not been able to be accomplished properly.

What is needed, then, is a joint structure and a method for shortening container-well units of railroad freight cars to result in strong, long-lasting, dependable, shortened container-well car units capable of carrying the full weight of lading for which the cars were originally designed, over a further lifetime of several years.

SUMMARY OF THE INVENTION

The present disclosure provides an answer to the aforementioned need for an improved structure and method for shortening container-carrying well cars to carry standard 40-foot cargo containers.

According to one aspect of the disclosure, a method for converting well car units is disclosed in which preexisting container support assemblies are removed from container well car side sills; a bottom chord of each side sill is disconnected from the side sill web plate; longitudinally extending sections of the top chord and web plate are removed from each side sill near an end of an extra-long container well car unit; an end portion of the car unit is moved into a new position closer to a longitudinally central remaining portion of the body of the car unit; the top chord and web plate portions are reconnected as shortened; the bottom chord is connected to the moved portion of the side sill web plate of the end portion of the car unit; a container corner support assembly including a transverse gusset plate is attached to the side sill at the end of the shortened container well; and a connecting plate is welded to a longitudinally outboard face of the transverse gusset plate and to an inboard face of a closure plate of a connecting portion of the end portion of the car unit, completing a pathway for transfer of forces between the container corner support assembly and a body bolster.

In accordance with one aspect of the disclosure, a joint structure includes structure interconnecting a side sill and a container corner support assembly of a container well car unit with a connecting assembly extending between a body bolster and the container corner support assembly, in which the connecting assembly includes a closure plate spaced inboard from an extension of a side sill web plate and connected to the extension of the side sill web plate by a transversely extending vertical support plate, and a connecting member is welded to the closure plate and to a transverse gusset plate that is part of the container corner support assembly.

In one embodiment a spacer member is located between the transverse gusset plate and the transverse vertical support plate and helps to shape a weld joint between those plates.

In one embodiment a connector plate lies alongside the closure plate and has a serpentine margin providing a long weld connection to the closure plate, while a vertical margin of the connector plate is welded to the transverse gusset plate so that the connector plate interconnects the closure plate with the transverse gusset plate across a gap between the transverse gusset plate and the vertical support plate of the connecting assembly.

The foregoing and other features of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF EMBODIMENTS

Figure 1:
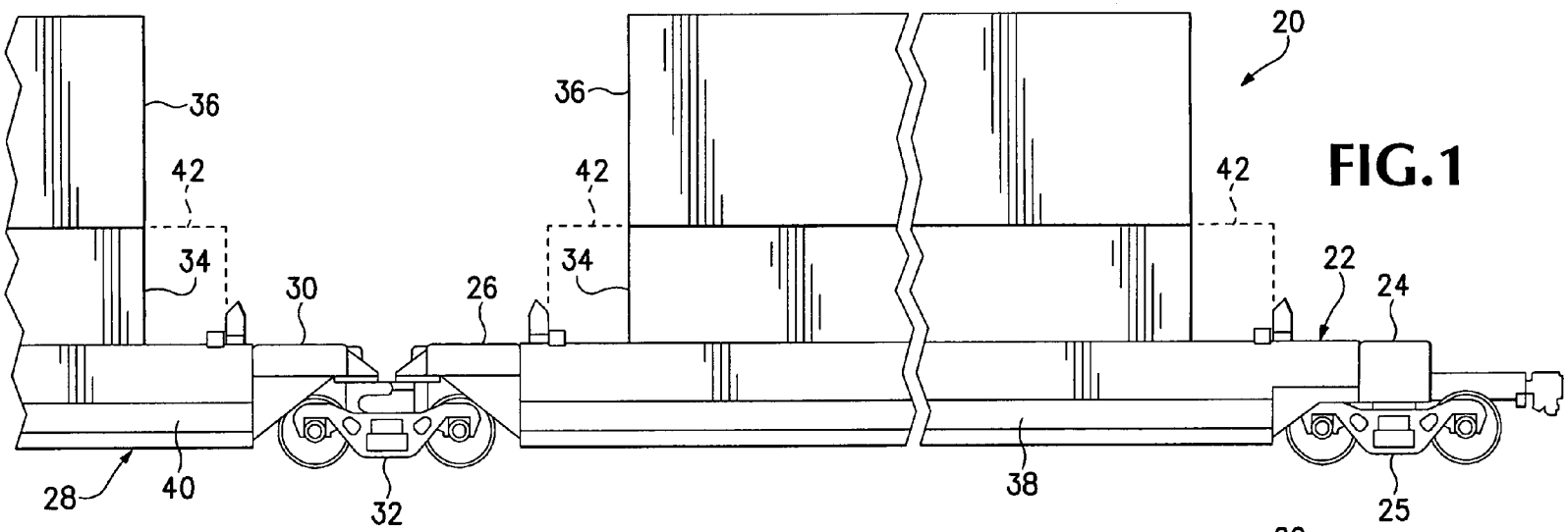
FIG. 1 is a foreshortened side elevational view of an end unit and a portion of an intermediate unit of a multi-unit railroad freight car including container wells defined between side sills of the car units to receive intermodal freight containers, and showing the car units carrying freight containers of a standard length that is less than the length of each container well.

Referring now to the drawings which form a part of the disclosure herein, in FIG. 1 a portion of a multi-unit railroad car 20 includes an end well car unit 22 that has an outer or coupler end 24 supported on a wheeled truck 25, and an intermediate end 26. An intermediate car unit 28 is coupled to the intermediate end 26 of the end unit 22, and an intermediate end 30 of the intermediate unit 28 and the intermediate end 26 of the end unit 22 are supported together on a shared truck 32. The well car 20 may have additional intermediate units (not shown) similar to the intermediate unit 28, as well as another end unit (not shown). Alternatively, a container well car may have only a single unit, in which case the single well car unit would have two coupler ends similar to the coupler end 24 shown in FIG. 1. As a further alternative, a multi-unit container-well car might have only two end units similar to the end unit 22 interconnected at an intermediate end 26 of each.

The multi-unit car 20 is shown laden with a pair of nominal 40-foot intermodal freight containers 34 and 36 carried in a container well of each car unit 22, 28. A lower tier container 34 is held within the each container well, and the upper 40-foot container 36 is stacked upon and locked to the lower container 34 in each container well. A respective container well is defined between the opposite side sills 38 of the end unit 22 and between the opposite side sills 40 of the intermediate unit 28. The container well of each well car unit 22, 28 receives the lower container 34 with room to spare at each end of the container 34, as shown in FIG. 1, since the container well is designed to receive nominal 48-foot containers 42 (shown in broken line), which would occupy the entire length of the container well of the well unit 22 or 28.

Figure 2:
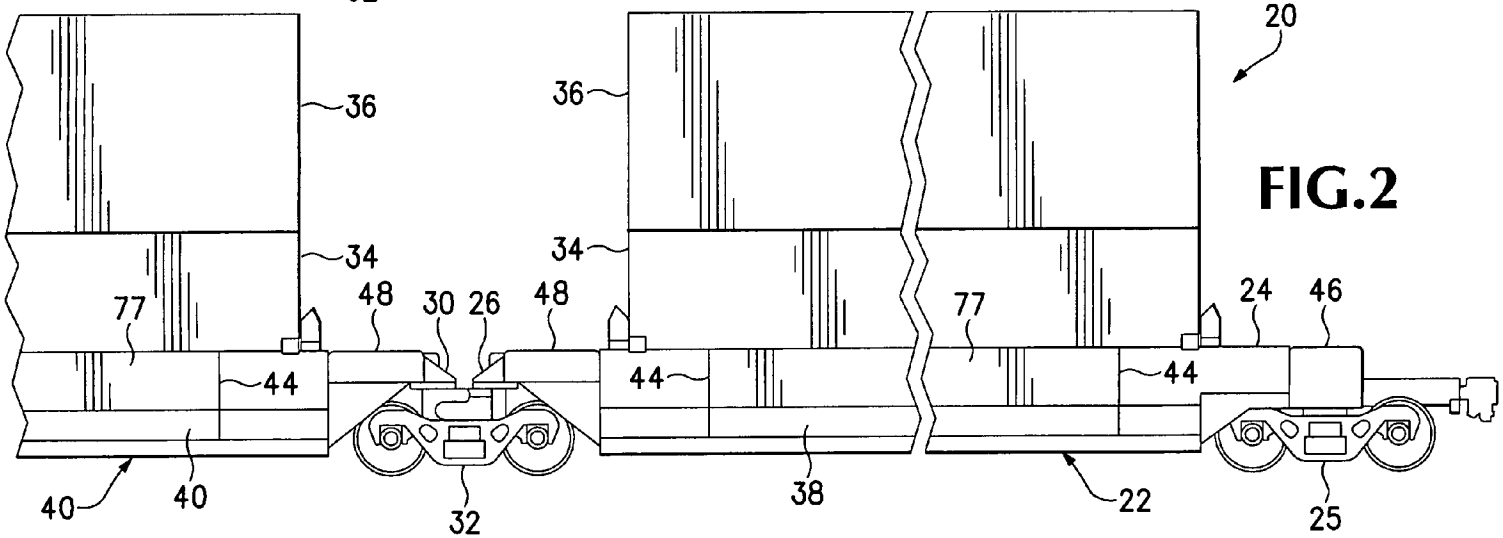
FIG. 2 is a foreshortened side elevational view of an end unit and a portion of an intermediate unit of the railroad freight car shown in FIG. 1, after conversion in which the separate units have been reduced in length to receive intermodal freight containers of a standard size, but without the capacity for carrying extra-long containers.

For the economic reasons explained above, it is desirable to convert such a multi-unit car 20 to a shorter configuration in which the container wells are still capable of carrying the 40-foot containers 34 and 36, but can no longer receive 48-foot containers 42. Accordingly, the multi-unit car 20 shown in FIG. 2 has been shortened as will be described herein presently, by removing a roughly 4-foot-long section of each side sill 38 and 40 at each end of each container well car unit 22 and 28, rejoining the top chord and web of each side sill 38 and 40 at respective seams 44, and by making changes to container supporting structures.

The side sills 38 of the end unit 22 are interconnected by a transversely extending body bolster 46 at the coupler end 24 and by a transversely extending body bolster 48 at the intermediate end 26. A respective body bolster 48 interconnects the side sills 40 of each intermediate unit 28 at each of its intermediate ends 30.

Figure 3:
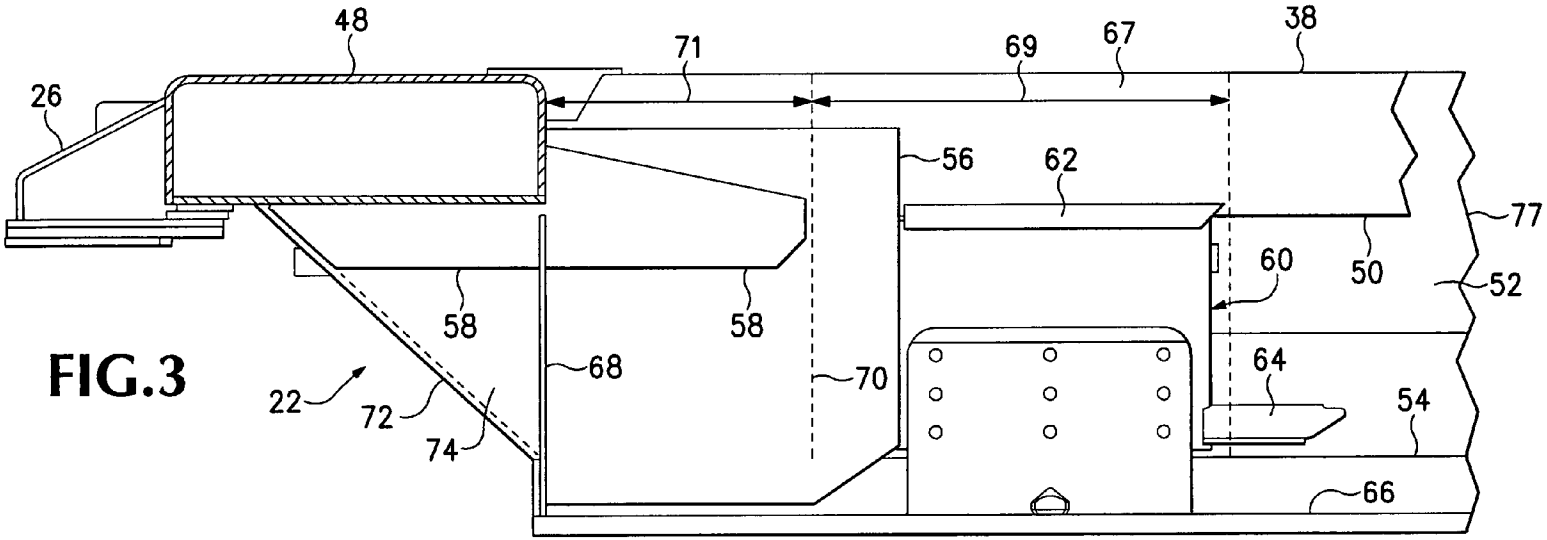
FIG. 3 is a side elevational view of a portion of a container well adjacent an intermediate end of an end unit of the freight car shown in FIG. 1, taken from within the container well and showing the body bolster of the car unit in sectional view.

Referring next to FIG. 3, the intermediate end 26 and a portion of the side sill 38 and the intermediate end 26 of the end unit 22 are shown in the configuration included in the multi-unit car 20 before conversion or shortening of the container wells from a 48-foot capacity to a 40-foot capacity. The side sill 38 includes a top chord 50 in the form of a deep outwardly-facing channel welded to a web plate 52 to form a box beam, or deep tube, structure. The web plate 52 extends downward and a lower part is angled diagonally inward to a bottom chord member 54 of heavier plate material bent into a form resembling an "L" with its horizontal portion directed laterally inward with respect to the container well.

A large reinforcing plate 56 and a doubler plate 58 extend vertically along the inboard, or container well, side of the side sill 38, between the body bolster 48 and a container support assembly 60 welded to the side sill 38. Attachment of the container support assembly 60 includes a bridge plate 62 welded to the top chord 50 and a reinforcing member 64 extending along a portion of the inboard face of the web plate 52.

A truss assembly 66 extends horizontally between the two side sills 38 at the bottom of the container wells, and extends longitudinally to the end of the container well, adjacent the body bolster 48. A gusset 68, shown only in edge view in FIG. 3, extends transversely at the end of the container well.

Figure 4:
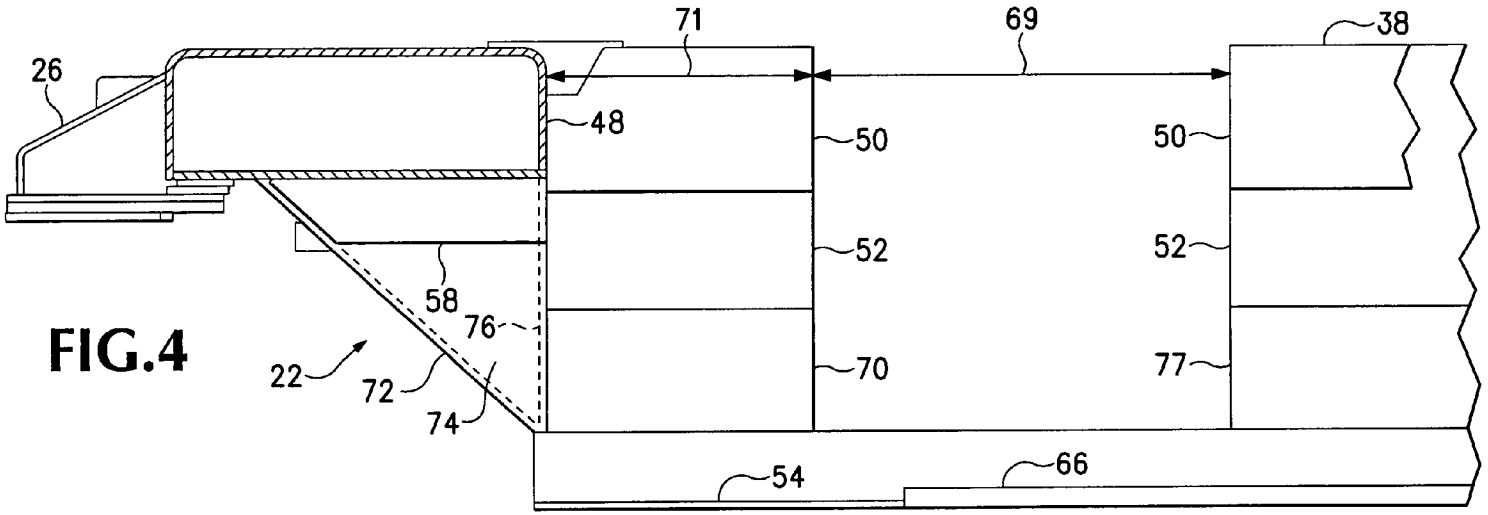
FIG. 4 is a view similar to FIG. 3, but showing the condition after removal of a container support assembly and portions of the side sill, in preparation for shortening the intermediate end of the illustrated car unit.

To prepare for shortening the container well, as shown in FIG. 4, the body of each well car unit 22 and 28 is supported on suitable stands and separated from the wheeled trucks 25 and 32. At the intermediate end 26 of each end unit 22, and at each intermediate end 30 of each intermediate unit 28, the reinforcement plate 56, the portion of the doubler plate 58 located longitudinally inboard from the body bolster 48, and the container support assembly 60, including its attachment bridge plate 62 and the reinforcing plate 64, are cut free from the top chord 50 and web plate 52 of the side sill 38, and a portion of the horizontal truss assembly 66 is removed. The bottom chord 54 is scarfed free from the lower margin of the web plate 52, through a distance extending from its outboard end longitudinally toward the center of the length of the end unit 22.

With the intermediate end 26 of the car unit, including the body bolster 48, supported on a suitable dolly that can be moved longitudinally with respect to the central portion of the body of the container car end unit 22, a portion of 67 the web plate 52 approximately four feet long is removed, and thereafter, or at the same time, a corresponding portion of the top chord 50 is removed, leaving the portion of the car shown in FIG. 3 in the condition shown in FIG. 4, in which the body bolster 48 and the adjacent portion of the side sill 38 are free to move with respect to the remainder of the car body, including the bottom chord member 54, which is left intact. The portion 67 of the side sill 38 to be removed may be selected so that the reconnecting joint 44 is located longitudinally inboard and clear of the location required for installation of a container corner support assembly adjacent the body bolster 48. For example, the removed portion 67 may have a length 69 of 44 inches, and a portion 70 left extending longitudinally inward from the body bolster 48 may have a length 71 of 28 inches.

The portion 70 of the side sill 38 that is left connected with the body bolster 48 includes a portion of the web plate 52 whose upper portion extends longitudinally alongside the respective end of the body bolster and whose lower portion is cut diagonally to form the laterally outer portion of a triangular connecting part 72. Spaced laterally inboard from the web plate 52 by a small distance that may vary from about two inches to about four inches is a vertical longitudinally extending closure plate 74 that is attached to the body bolster 48. Transverse structural members including a generally vertical and transverse support plate 76 interconnect the closure plate 74 with the side sill web plate 52 in the triangular connecting assembly 72. The remaining portion of the doubler plate 58 overlies and is securely fastened to the closure plate 74. In preparing to shorten the well unit, when the reinforcing plate 56 is removed, the transverse generally vertical support plate 76 is exposed and the closure plate 74 is trimmed along the exposed face of the vertical support plate 76. The doubler plate 58 is also cut back to be flush with the exposed longitudinally inboard face of the transverse vertical support plate 76.

Carried on a suitable wheeled dolly, for example, or otherwise movably supported, the body bolster 48 and the attached connecting parts 72 and the end portion 70 of the side sill, including its top chord 50 and side plate 52, are moved longitudinally with respect to the remaining longitudinally central portion 77 of the body of the end unit 22, and the corresponding portions of the top chord 50 and side sill web plate 52 are aligned with each other, with a small gap 78 left for properly welding the corresponding parts together. A series of slots 80 are formed through the side sill web member 52 to be used to weld a container corner support assembly 81 into place within the shortened container well.

Figure 8:
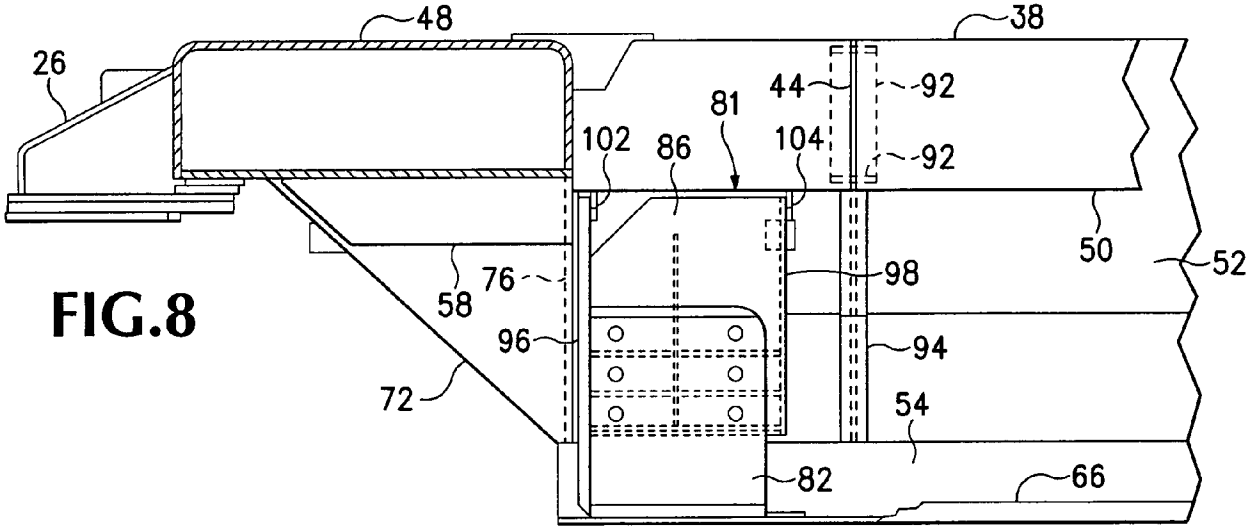
FIG. 8 is a view similar to that of FIG. 5, showing the side sill parts rejoined and a container support assembly such as that shown in FIGS. 6 and 7 located in the corner formed between the side sill and the body bolster, at an intermediate stage of the procedure of attachment of the container support assembly.
Figure 7:
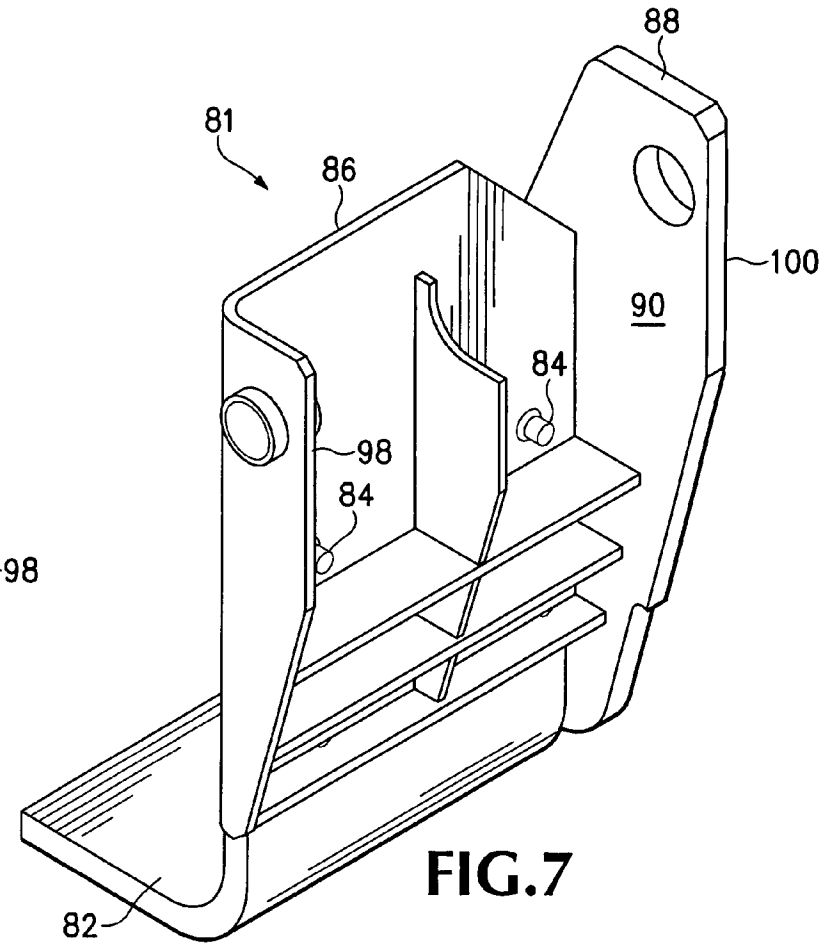
FIG. 7 is an isometric view of the container support assembly shown in FIG. 6, taken from a laterally outer viewpoint.
Figure 6:
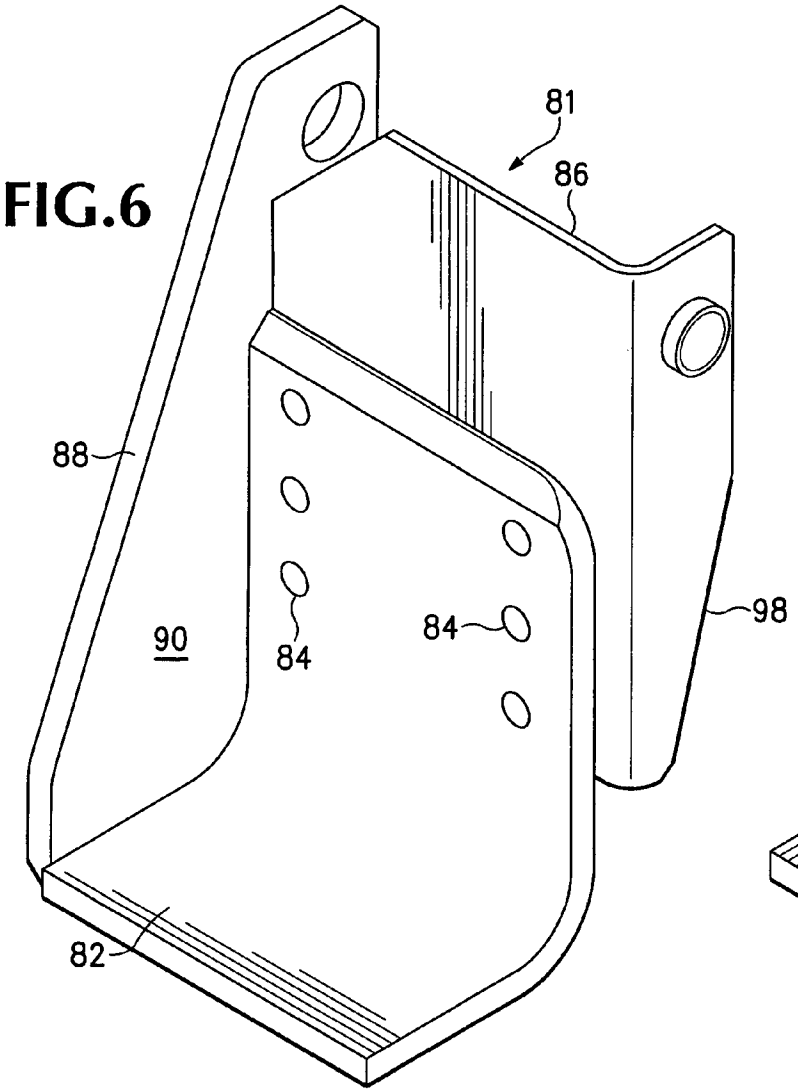
FIG. 6 is an isometric view of a container support assembly to be installed in the container well shown in FIG. 5 to replace the container support assembly shown in FIG. 3, as seen from a viewpoint within a container well including such a container support assembly.

As shown in FIGS. 6, 7, and 8, the container corner support assembly 81 includes a support foot 82 which may be made by cutting down a corresponding portion of the container support assembly 60 that was originally included in the well car unit 22. The support foot 82 is fastened by suitable fasteners, such as Huck bolts 84, to a support bracket 86 that may be a weldment of suitably formed plate material with stiffening webs and shaped to fit snugly against a laterally inner face of the side sill web plate 52. A transverse vertical gusset plate 88 extends alongside the support foot 82 and the support bracket 86, and the adjacent members of the support bracket 86 are welded to a longitudinally inboard face 90 of the gusset plate 88 prior to attachment of the support foot 82 to the support bracket 86. The gusset plate 88 may be of thick plate material, such as 1.5 inch thick steel plate, to be able to carry a large part of the forces caused by the mass of containers carried in the container well, as well as other forces experienced by the side sills 38 as a result of inclusion of the car 20 in a train.

Figure 5:
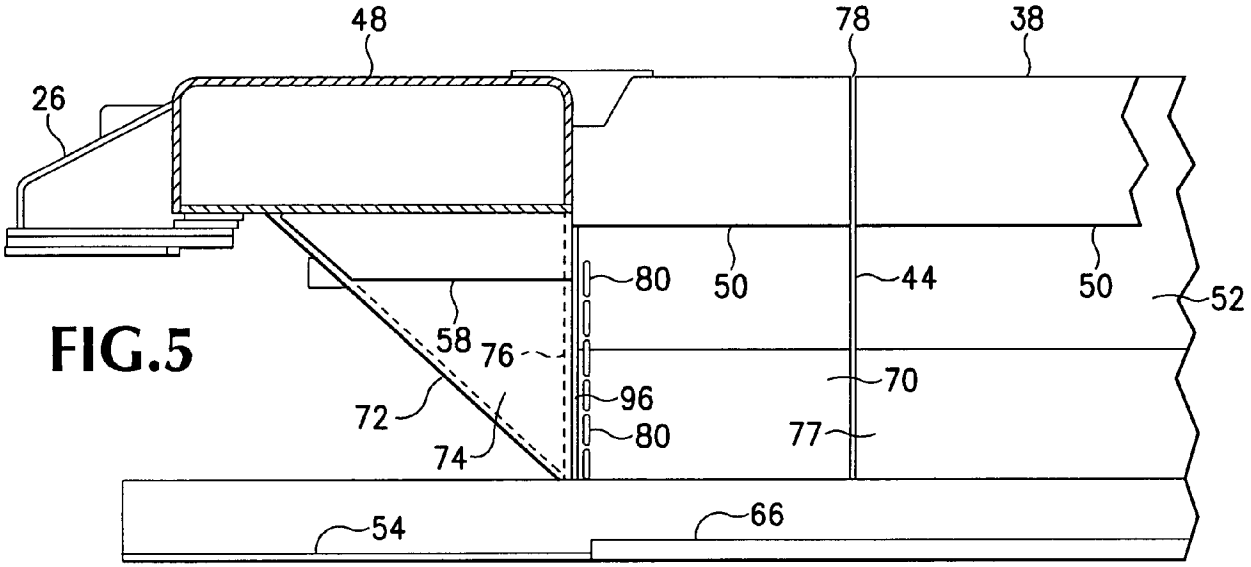
FIG. 5 is a side elevational view taken in the same direction as FIGS. 3 and 4, with the body bolster and the attached portions of the side sill moved longitudinally into a position adjacent a longitudinally central portion of the car unit body, in preparation for reconnection to provide a shorter container well.
Figure 9:
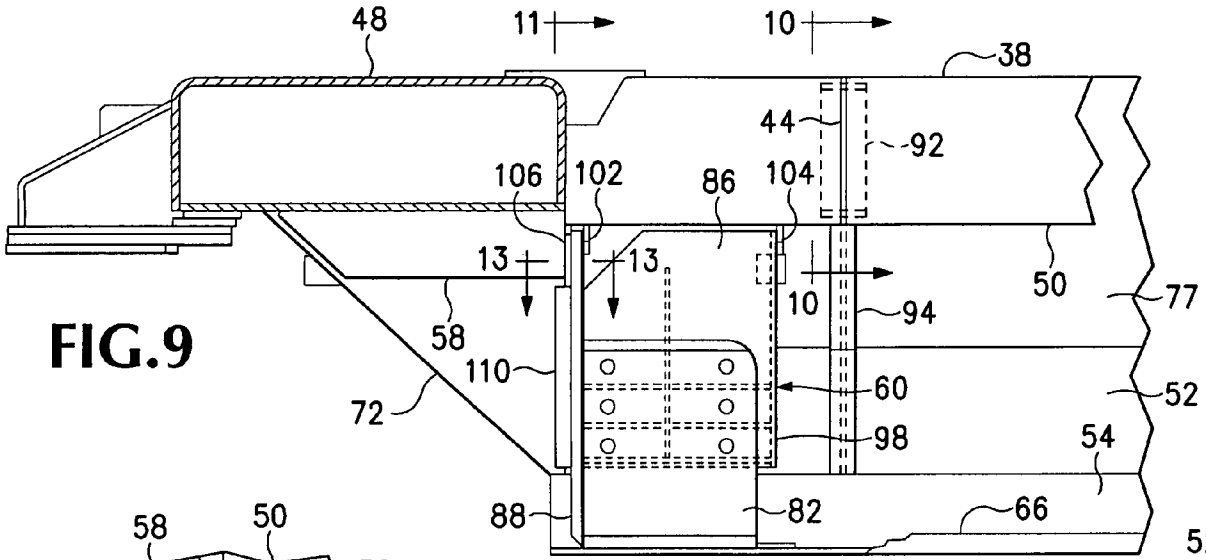
FIG. 9 is a sectional detail view taken along line 9-9 in FIG. 8.
Figure 10:
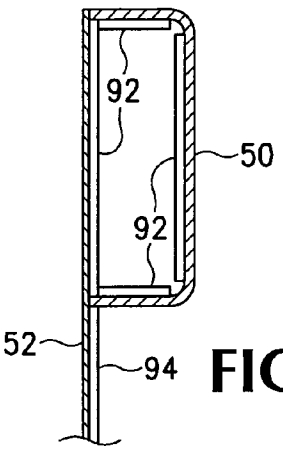
FIG. 10 is a view similar to that of FIG. 9, showing the container support assembly mounted in the corner of the container well between the side sill and the body bolster.

In interconnecting the end portion 70 of the side sill 38 with the longitudinally central portion 77 of the side sill 38, as shown in FIGS. 8, 9, and 10, backing bars 92 are tacked within the top chord 50 and a backing bar 94 is tacked to the inwardly facing surface of the side sill web plate 52, bridging the gap 78 shown in FIG. 5, to support suitable weld joints to form the seam 44.

The bottom chord 54 is welded to the lower margin of the side sill web plate 52 in the end portion 70 of the side sill, and the excess portion of the bottom chord 54 is cut off, as may be seen in FIG. 8. The container corner support assembly 81 is then placed in position atop the bottom chord 54 and against the laterally inner face of the side sill web plate 52. A gap 96 is left, between the gusset plate 88 and the exposed face of the transverse vertical support plate 76, which is generally coplanar with the longitudinally inboard margins of the closure plate 74 and the overlying doubler plate 58, which extend along the exposed face of the transverse vertical support plate 76.

The longitudinally inboard margin 98 of the support bracket 86 is welded to the laterally inner face of the side sill web plate 52, and the outer margin surface 100 of the transverse gusset plate 88 is welded to the side sill web plate 52 by use of the slots 80 shown in FIG. 5. Filler pieces 102 and 104 are welded to the transverse gusset plate 88 and to the longitudinally inboard side of the support bracket 86 to connect them to the side sill web plate 52 and the bottom of the top chord 50.

Figure 11:
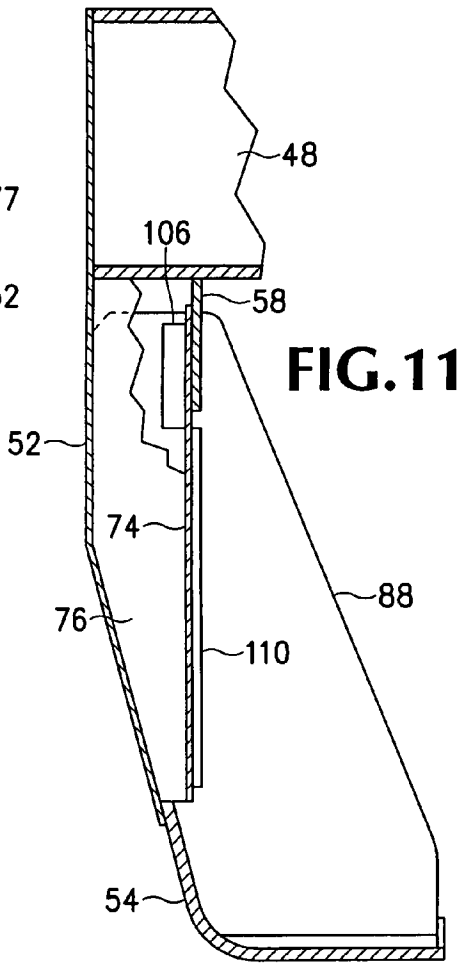
FIG. 11 is a sectional view, taken along line 11-11 of FIG. 9, showing details of the interconnection between the container support assembly and a connecting assembly joining the side sill to the body bolster.
Figure 12:
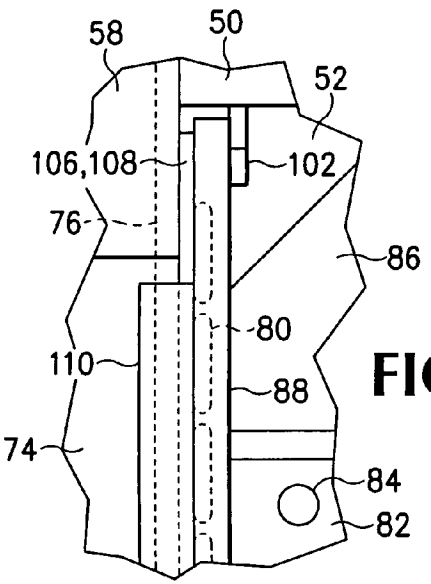
FIG. 12 is a detail view, at an enlarged scale, of interconnection of the container support assembly and adjacent parts of the side sill of the container car well unit as shown in FIG. 10.
Figure 13:
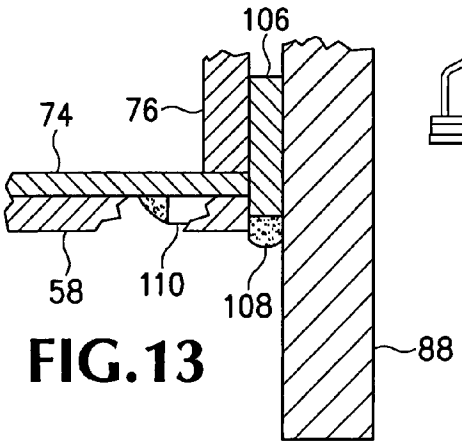
FIG. 13 is a sectional view, taken along line 13-13 of FIG. 9.

The size of the gap 96 may be determined fairly accurately in its upper portion, leaving space for a slot weld between the transverse gusset plate 88 and the doubler plate 58 and the adjacent portion of the vertical support plate 76. However, because the location of the vertical support plate member 76 as originally installed was not critical when the car unit was built to include a 48-foot container well, the lower portion of the gap 96 may not be of the same width, as a result of the original construction of the container well unit 22 that is being shortened. Nevertheless, a strong and durable welded interconnection between the transverse gusset plate 88 of the container corner support assembly 81 and the triangular connecting assembly 72 of the intermediate end 26 is critical, so that the forces to which the container corner support assembly 80 is exposed can be carried efficiently to the body bolster 48. In forming such a connection a spacer plate 106 of suitable thickness, such as 0.5 or 0.375 inch, is tacked in place between the vertical transverse gusset plate 88 and the generally coplanar surfaces of the margins of the doubler plate 58 and the cover plate 74, and the inboard face of vertical support plate 76, as shown in FIGS. 9, 11, and 12. A deep slot weld joint 108 is then formed as shown in FIG. 13, to interconnect the gusset plate 88 and the doubler plate 58 and to retain the spacer plate 106 where it can carry compressive loads. The weld joint 108 then provides a path to transmit tensile forces between the transverse gusset plate 88 and the connecting assembly 72.

A reinforcing connector bar 110 of ample thickness, at least equal or greater than the thickness of the closure plate 74, is placed alongside and welded to the face of the closure plate 74 to bridge the lower portion of the gap 96. A margin of the reinforcing connector bar 110 is located adjacent and welded securely to the longitudinally outboard face of the transverse vertical gusset plate 88, connecting the lower part of the gusset plate 88 to the connecting assembly 72.

To complete the installation of the container support assembly a reinforcing cover plate 112 is welded to the top chord 50, the longitudinally inboard face 90 of the gusset plate 88 and the support bracket 86, covering the opening that was previously available at the top of the support bracket 86 to allow the filler piece 102 to be installed. The cover plate 112 connects the support bracket 86 to the top chord 50. A connecting piece 114 is welded in place to bridge the remaining space between the top chord 50 and the top of the support bracket 86, and an attachment bracket 116 is welded to the support bracket 86 and the laterally inward face of the side sill web plate 52.

While only one side of the container well at the intermediate end 26 has been shown and described, the operation is similar on the opposite side sill 38 and thus need not be described in detail. Also, the shortening of the container well at the intermediate end portion 30 of each intermediate unit 28 is performed substantially similarly to the shortening of the container well at the intermediate end 26 of the end unit 22 as just described, and thus need not be discussed in detail.

Figure 15:
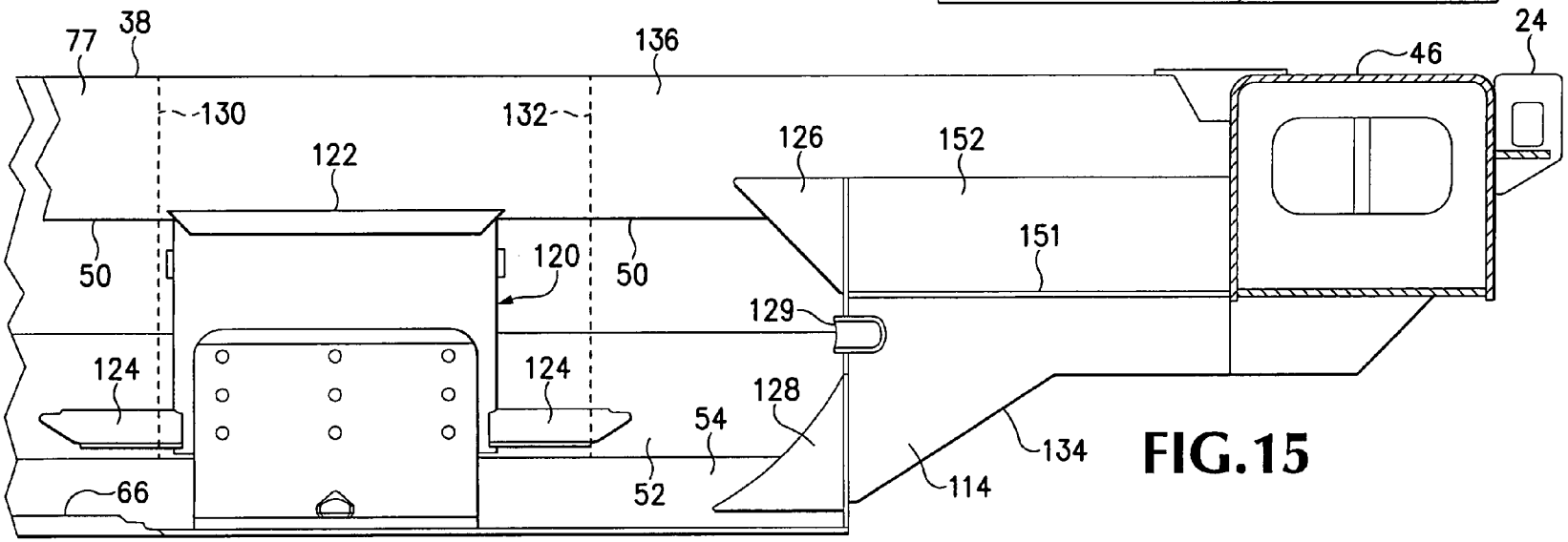
FIG. 15 is a side elevational view taken in the same direction as FIGS. 3 and 4 from inside the container well at the coupler end of the end car unit shown in FIG. 1, with the body bolster shown in sectional view.

The coupler end 24 of the end container well unit 22 of the multi-unit car 20 is prepared for shortening the container well by a procedure generally similar to that described above with respect to the intermediate end 26. A container support assembly 120 and associated connecting parts 122 and 124 are scarfed free from the side sill 38. Generally triangular gussets 126 and 128 are scarfed free from the top chord 50 and bottom chord 54, respectively, and a pipe-like piece 129 is cut back flush. The bottom chord 54 is scarfed free from the side sill web plate 52, and the top chord 50 and side sill web plate 52 are shortened by removal of a section such as that indicated by broken lines 130 and 132 in FIG. 15. The body bolster 46, an attached connecting assembly 134 of each lateral side of the car unit 22, and the attached short end portion 136 of each side sill 38 are moved longitudinally into alignment with the remaining longitudinally central portion 77 of the body of the end unit 22, in much the same fashion as described above with respect to the intermediate end 26, in order to join them at the seam 44.

Figure 16:
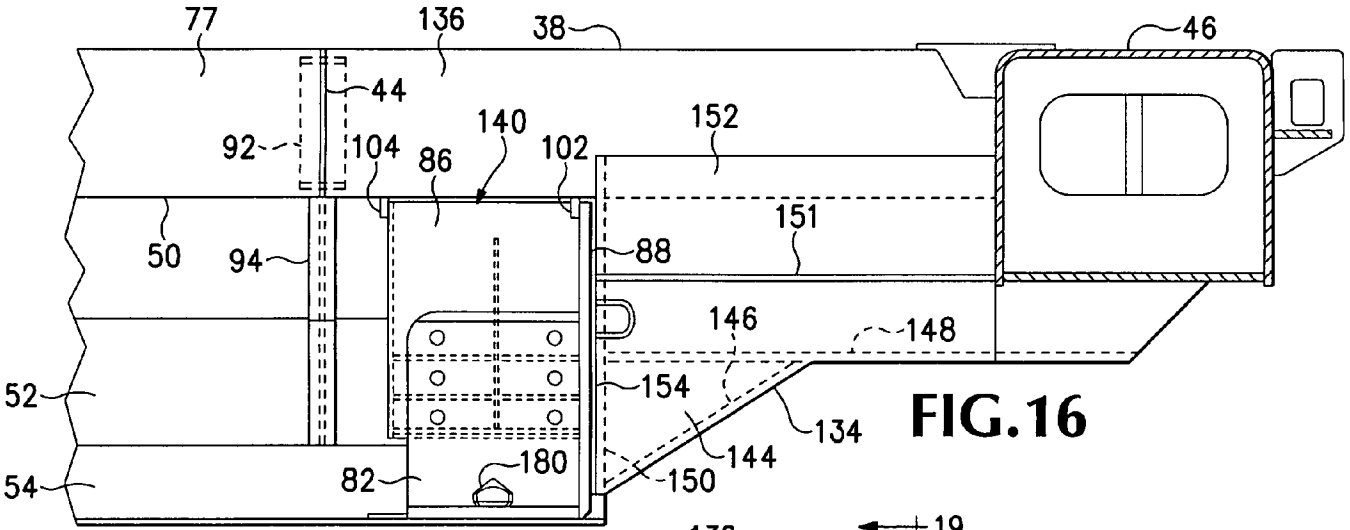
FIG. 16 is a side elevational view similar to FIG. 15, but with the side sills shortened and a container corner support assembly partially installed during the conversion of the car unit to have a shorter container well.

As shown in FIG. 16, a container corner support assembly 140 substantially similar to the container corner support assembly 81 is installed in the coupler end 24 of the shortened container well in generally the same manner as was the container corner support assembly 81 at the intermediate end 26. The container corner support assembly 140 shown in FIG. 16 is substantially a mirror image of opposite hand from the container support assembly 81 shown in FIGS. 6 and 7 and described previously, and it will be understood that a pair of opposite-hand assemblies 140 are required for the coupler end 24.

Figure 19:
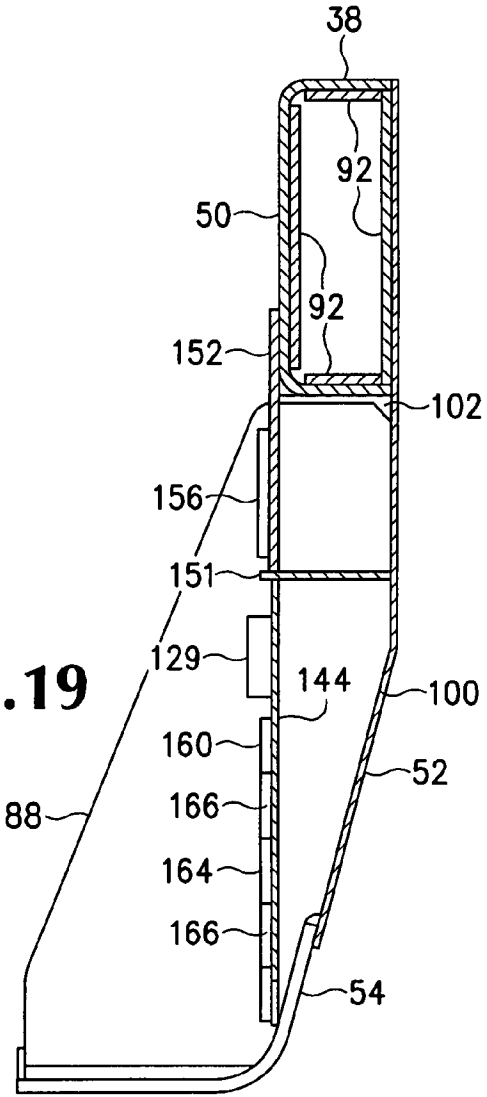
FIG. 19 is a partially sectional end elevational view, taken along line 19-19 of FIG. 17, showing the interconnection of the end portion of the side sill to a container support assembly at the coupler end of the end unit of the container-well car shown in FIG. 2.

Similar to the intermediate end triangular connecting part 72, the longer connecting assembly 134 between the side sill 38 and the body bolster 46 at the coupler end 24 of the container well car unit 22 includes continuations of the top chord 50 and the side sill web plate 52 of the side sill 38. Spaced laterally inward from the web plate 52 with its upper portion at a distance about equal to the lateral width of the top chord 50 is a flat closure plate 144. A structural spacer member 146 extends along a diagonally sloping bottom portion of the connecting assembly 134, and a horizontal structural spacer member 148 extends for the length of the connecting assembly 134, connecting the closure plate 144 with the lower portion of the side sill web plate 52, in a lower portion of the connecting assembly 134. Also, as in the triangular connecting assembly 72, a transverse vertical support plate 150 extends from the top chord 50 to the bottom of the connecting assembly 134, joining the side sill web plate 52 with the closure plate 144 in the same manner as does the vertical support plate 76 at the intermediate end 26. As shown also in FIGS. 19 and 22, a horizontal gusset 151 is located at the top of the closure plate 144 and extends to the side sill web plate 52 as the top of a box beam structure of the lower portion of the connecting assembly 134. A connecting or upper closure plate 152 that may be heavier than the closure plate 144 extends upward from the gusset 151, aligned with and above the closure plate 144, and is welded to the top chord 50, as an inboard side of an upper longitudinal box beam portion of the connecting assembly 134 at the coupler end 24.

A gap 154, similar to the gap 96, extends vertically, between the longitudinally outboard face of the transverse gusset plate 88 of the container corner support assembly 140 and the aligned longitudinally inboard margins of the closure plate 144 and upper closure plate 152 and the longitudinally inboard face of the transverse vertical support plate 150.

Figure 17:
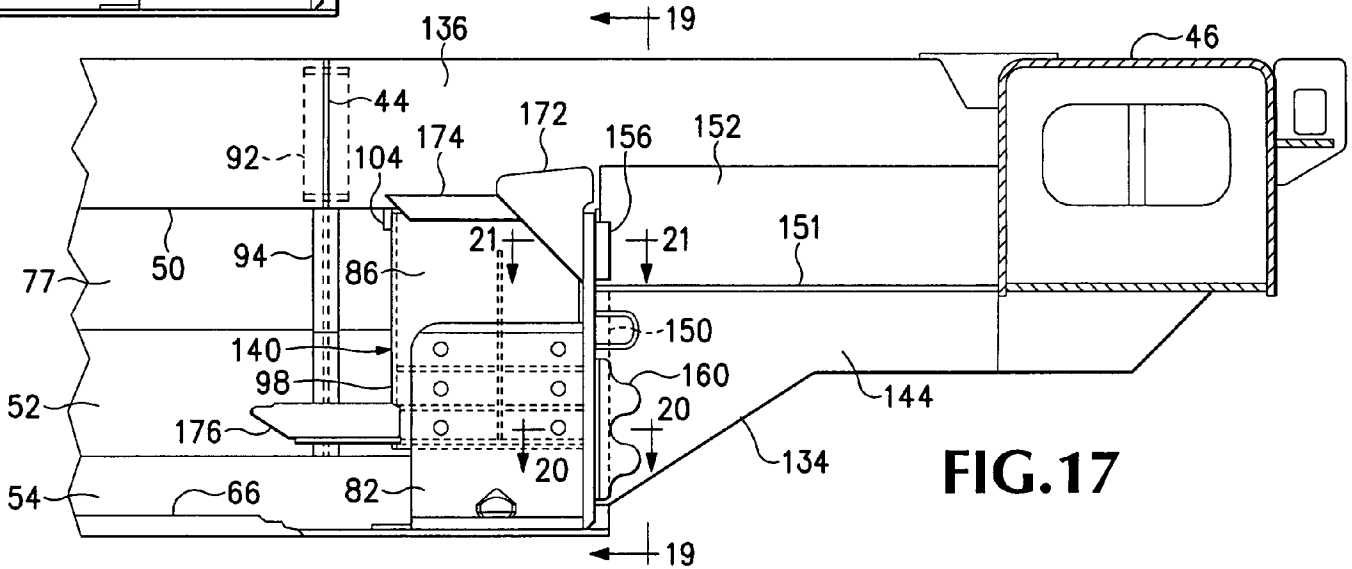
FIG. 17 is a view similar to FIG. 16 in section, showing the container support assembly fully installed and the coupler end portions of the car unit reattached according to the method and structures disclosed herein.
Figure 21:
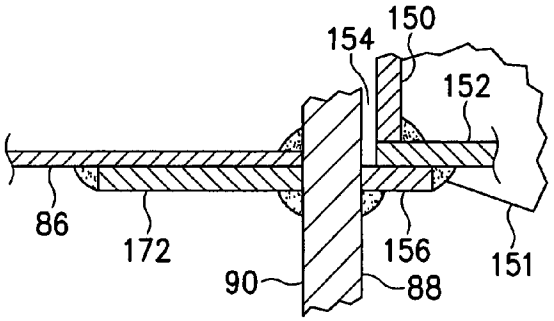
FIG. 21 is a sectional view taken along line 21-21 of FIG. 17.

In order to provide the required strong durable connection between the container corner support assembly 140 and the connecting assembly 134, a short upper connector plate 156 has an inboard margin securely welded to the longitudinally outboard face of the gusset plate 88 of the container support assembly 140 and lies closely alongside and is welded to a laterally inboard face of the upper closure plate 152, bridging the gap 154 as shown in FIG. 17, and as also shown in section in FIG. 21.

Figure 18:
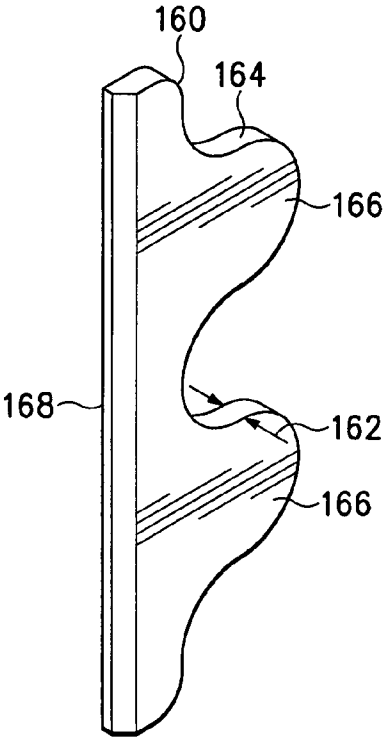
FIG. 18 is an isometric view of a connecting and reinforcing plate shown in FIG. 17, and that is used to interconnect a side sill closure plate with a gusset plate of the container support assembly.
Figure 20:
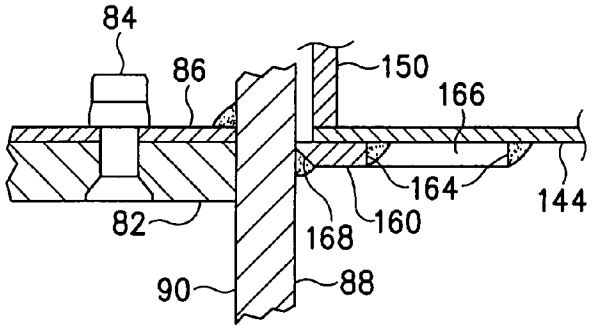
FIG. 20 is a sectional view taken along line 20-20 of FIG. 17.

A reinforcing connector plate 160, also shown separately in a larger view in FIG. 18, lies closely alongside the closure plate 144 in the lower portion of the connecting assembly 134. A straight margin 168, which may be chamfered, extends vertically along and is securely welded to the longitudinally outboard face of the gusset plate 88 so that the connector plate 160 also bridges the gap 154. The connector plate 160, as may be seen in FIG. 18, may be of relatively heavy plate, by comparison with the closure plate 144, and has a thickness 162 of 0.5 inch, for example. The reinforcing connector plate 160, in one embodiment, has a profile resembling a camel's back, defining a serpentine margin 164 extending along a pair of lobes 166. As shown in FIG. 20 the serpentine margin 164 is welded securely to the closure plate 144, in a long and secure weld seam that may be at least twice as long as the vertical margin 168, through which to transfer forces to or from the closure plate 144, between the connecting assembly 134 and the longitudinally outboard face of the gusset plate 88.

As in the intermediate end 26 described above the lower margin of the gusset plate 88 is securely welded to the bottom chord member 54, and the outer margin is welded to the side sill web plate 52 through slots similar to the slots 80 shown in FIGS. 5 and 12.

Figure 14:
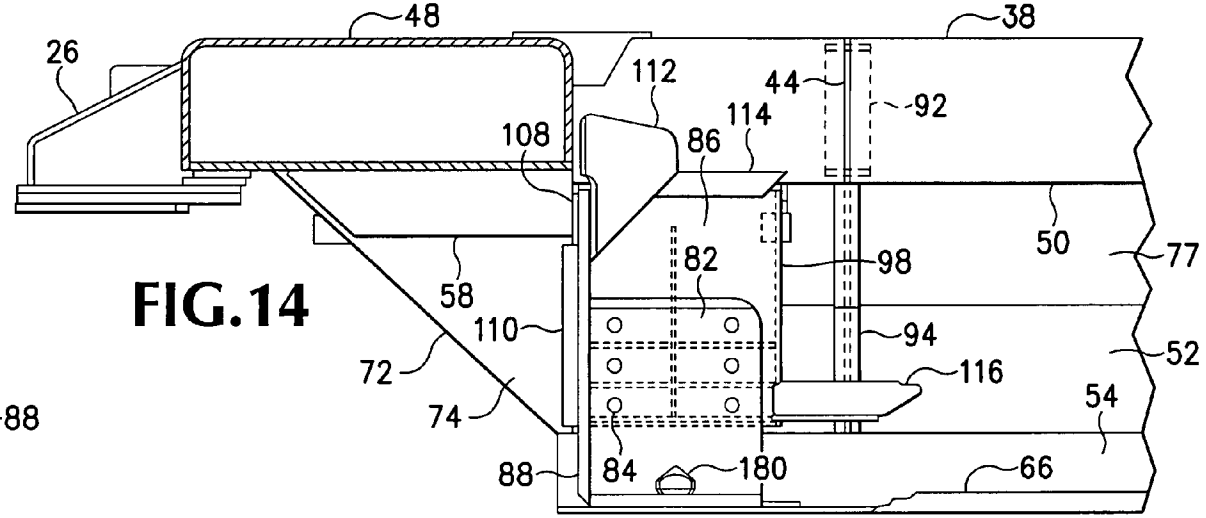
FIG. 14 is a view similar to FIG. 9, showing additional parts completing installation of the container support assembly.

A reinforcing cover plate 172, similar to the cover plate 112 shown in FIG. 14, closes the opening at the top of the support assembly 120 and is welded to the support bracket 86, the gusset plate 88, and the top chord 50. A connecting piece 174 also interconnects the top margin of the support bracket 86 with the top chord 50, and an attachment bracket 176 fastens the inboard side support bracket 86 to the lower portion of the side sill web plate 52.

Figure 22:
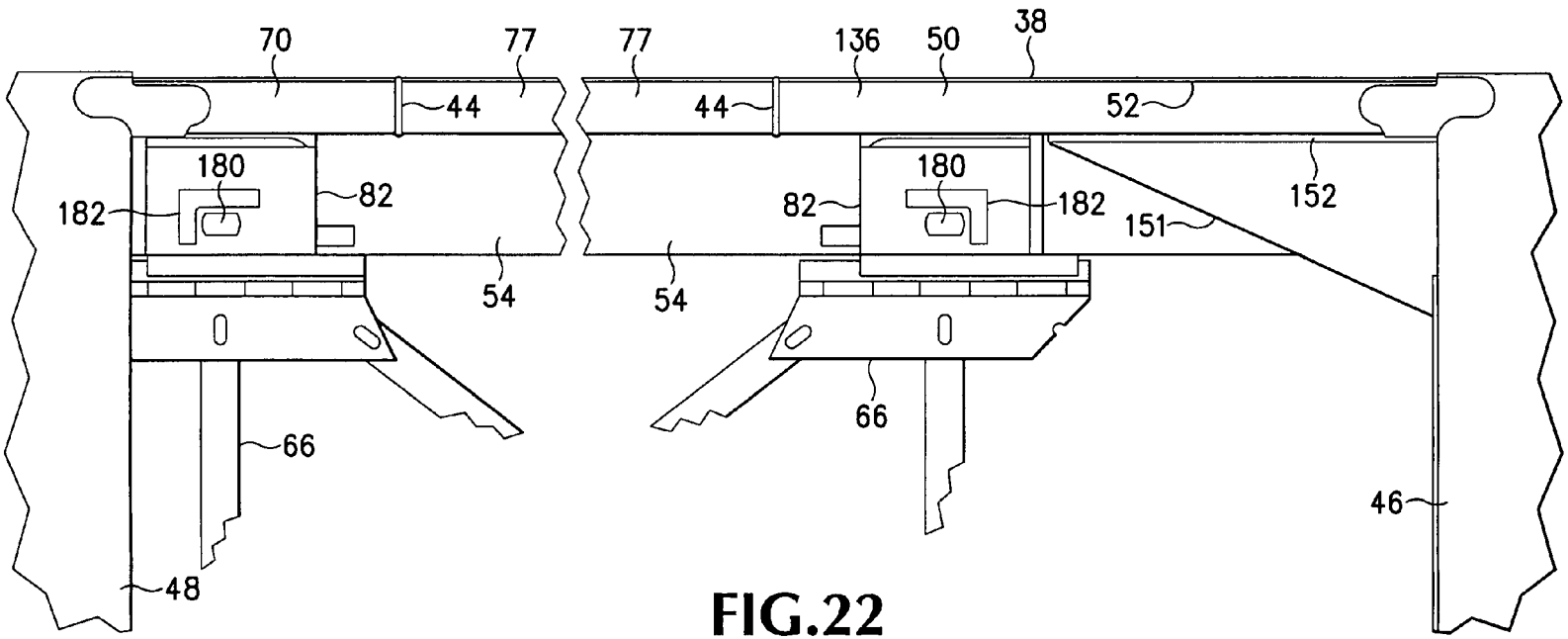
FIG. 22 is a foreshortened top plan view of one side sill and a portion of each body bolster of the end unit of the multi-unit container-well car shown in FIG. 2.

After reconnection of the shortened side sills 38 and installation of the container support assemblies 81 and 140, container locator cones 180 and support pads 182 may be installed on the container support feet 82, as shown best in FIG. 22.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A container well unit for a railroad freight car, the container well unit including a pair of deep, longitudinally extending side sills spaced laterally apart from each other and defining a container well for intermodal freight containers, the container well unit comprising:

(a) a well unit end assembly, including a transversely extending body bolster and a pair of generally vertically and longitudinally extending connecting assemblies, each of the connecting assemblies including a respective side sill web plate extension, a closure plate extending generally vertically and longitudinally of the car and located a distance laterally inboard from the side sill web plate extension, and a transverse, vertical support plate proximate the container well and interconnecting the side sill web plate extension with the closure plate, the closure plate having an inboard margin extending along the transverse vertical plate;

(b) a container corner support assembly welded to the side sill adjacent an end of the container well, the container corner support assembly including a gusset plate oriented vertically and transversely and located proximate the transverse vertical support plate of a respective one of the pair of connecting assemblies, the gusset plate having a laterally outward margin welded to the side sill web plate; and (c) a connector member lying alongside and welded to the closure plate, the connector member extending toward the gusset plate and having an inboard margin extending along and welded to a longitudinally outboard face of the gusset plate, the connector member thereby carrying forces between the gusset plate and the closure plate and enabling the closure plate and the transverse vertical support plate to transmit forces between the side sill and the body bolster.

2. The container well unit of claim 1 wherein the well unit end assembly is at an intermediate end of the container well unit and wherein the respective one of the pair of connecting assemblies is generally triangular and the body bolster is attached to a top of the connecting assembly.

3. The container well unit of claim 2 including a reinforcing plate mounted on an upper portion of the closure plate, and a spacer located between the longitudinally outboard face of the gusset plate and a face of the transverse vertical support plate of the respective one of the pair of connecting assemblies, and wherein the reinforcing plate and the spacer are welded to the gusset plate above the connecting member.

4. The container well unit of claim 1 wherein the container well unit end assembly is at a coupler end of the container well unit and the respective one of the pair of connecting assemblies extends longitudinally away from the container well to a body bolster spaced apart from the container well.

5. The container well unit of claim 4 wherein the respective one of the pair of connecting assemblies has a lower portion and the connector member is located in said lower portion.

6. The container well unit of claim 5 wherein the connector member has a serpentine margin lying alongside and welded to the closure plate.

7. The container well unit of claim 6 wherein the serpentine margin of the connector plate is at least twice as long as a straight vertical margin of the reinforcing plate, thereby spreading loads carried by the reinforcing plate over an area of the closure plate.

8. The container well unit of claim 5 wherein the reinforcing connector member has a plurality of lobes extending alongside and welded to the closure plate, and wherein an extended weld joint connects the reinforcing connector to the closure plate.

9. The container well unit of claim 4, wherein the respective one of the pair of connecting assemblies includes a longitudinal upper closure plate in an upper portion thereof, and including a second connector member lying alongside and welded to the longitudinal upper closure plate, the second connector member having an inboard margin extending along and welded to an upper portion of a longitudinally outboard face of the gusset plate.

10. The railroad car unit of claim 4 wherein the connector member has a chamfered margin welded to the gusset plate of the container support assembly.

11. A method of shortening a container well unit of a railroad freight car, comprising:

(a) removing a container support assembly from a side sill within a container well;

(b) removing a section of a side sill web plate spaced apart from a respective body bolster leaving an end portion of the side sill web plate interconnected with the body bolster;

(c) disconnecting a bottom chord member of the side sill from the end portion of the side sill web plate that remains interconnected with a body bolster;

(d) cutting away and removing a portion of a top chord of the side sill;

(e) thereafter, moving the body bolster and attached portions of the top chord and web plate of the side sill toward a longitudinally central portion of the side sill and into mating alignment therewith;

(f) joining corresponding portions of the top chord and side sill web plate of the end portion and the longitudinally central portion to each other;

(g) joining the bottom chord member to the end portion of the side sill web plate, thereby providing a shortened side sill structure;

(h) placing a container corner support assembly including a transversely and vertically oriented gusset plate adjacent an interior side of the shortened side sill structure;

(i) welding an outer margin of the gusset plate to the side sill web plate; and (j) welding a connector member to a laterally inner face of a connecting assembly and to a longitudinally outer face of the gusset plate, thereby interconnecting the connecting assembly with the container support assembly at a location spaced laterally inwardly a distance apart from the side sill web plate and forming a path through the connecting assembly for transmission of forces between the container corner support assembly and the body bolster.

* * * * *